US007567763B2

(12) United States Patent
Takahashi

(10) Patent No.: US 7,567,763 B2
(45) Date of Patent: Jul. 28, 2009

(54) IMAGE FORMING APPARATUS AND IMAGE FORMING METHOD CAPABLE OF DETECTING A RESISTANCE VALUE OF AN INTERMEDIATE TRANSFERRING MEMBER

(75) Inventor: Koji Takahashi, Tokyo (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 440 days.

(21) Appl. No.: 11/455,080

(22) Filed: Jun. 16, 2006

(65) Prior Publication Data

US 2007/0003300 A1 Jan. 4, 2007

(30) Foreign Application Priority Data

Jun. 30, 2005 (JP) ..... 2005-192922

(51) Int. Cl.
*G03G 15/00* (2006.01)
*G03G 15/02* (2006.01)
*G03G 15/16* (2006.01)

(52) U.S. Cl. ..... 399/26; 399/44; 399/50; 399/66

(58) Field of Classification Search ..... 399/26, 399/44, 50, 66, 89
See application file for complete search history.

(56) References Cited

U.S. PATENT DOCUMENTS

| | | | | |
|---|---|---|---|---|
| 5,179,397 | A | 1/1993 | Ohzeki et al. | |
| 6,112,036 | A * | 8/2000 | Shinohara | 399/26 |
| 6,282,386 | B1 * | 8/2001 | Ishii | 399/66 |
| 7,319,829 | B2 * | 1/2008 | Comstock | 399/66 |
| 7,330,674 | B2 * | 2/2008 | Ahn et al. | 399/66 |

* cited by examiner

*Primary Examiner*—William J Royer
(74) *Attorney, Agent, or Firm*—Turocy & Watson, LLP

(57) ABSTRACT

An image forming apparatus capable of detecting a resistance value of an intermediate transferring member at a stabilized sensitivity irrespective of the influences of environmental conditions, disturbing elements, etc. and contributing to the promotion of the image quality when forming images. The image forming apparatus is equipped with an electric potential controller to fix electric potential of the photosensitive surface of a photosensitive drum, a power source to supply a prescribed voltage or current to the photosensitive surface through the transferring surface of an intermediate transferring member, and a resistance detector to detect a current value flowing through the intermediate transferring member against a prescribed voltage supplied from the power source or a voltage value generated in an intermediate transferring member against a prescribed current and detect a resistance value of the intermediate transferring member based on the detected current value or voltage value.

17 Claims, 7 Drawing Sheets

| DETECTED VOLTAGE (V1) | MONO-CHROMATIC MODE | COLOR MODE | | | |
|---|---|---|---|---|---|
| | K | Y | M | C | K |
| 400 | 1.70 | 2.15 | 1.75 | 1.50 | 1.50 |
| 600 | 1.55 | 1.82 | 1.55 | 1.37 | 1.37 |
| 1000 | 1.20 | 1.29 | 1.21 | 1.15 | 1.15 |
| 1500 | 1.12 | 1.23 | 1.14 | 1.06 | 1.06 |
| 2200 | 1.00 | 1.13 | 1.02 | 0.96 | 0.96 |
| 4000 | 0.93 | 1.00 | 0.91 | 0.86 | 0.86 |

RESISTANCE COMPUTING EXAMPLE v1 = DETECTED VOLTAGE v2 = OUTPUT AT IMAGE TRANSFERRING a = COEFFICIENT (SETTABLE IN COLOR MODE Y, M, C, K, MONOCHROMATIC MODE

V2 = V1 × a

FIG. 6

EXAMPLES OF COEFFICIENT COMPUTING FORMULAE FOR DETECTED VOLTAGE

| DETECTED VOLTAGE (v) | MONOCHROMATIC "K" |
|---|---|
| | A=COEFFICIENT, B=DETECTED VOLTAGE |
| 400 ~ 600 | $A=2.0-7.5\times10^{-4}\times B$ |
| 600 ~ 1000 | $A=2.075-8.075\times10^{-4}\times B$ |
| 1000 ~ 1500 | $A=1.36-1.6\times10^{-4}\times B$ |
| 1500 ~ 2200 | $A=1.38-1.7\times10^{-4}\times B$ |
| 2200 ~ 4000 | $A=1.09-3.88\times10^{-5}\times B$ |

FIG. 8

IMAGE FORMING APPARATUS AND IMAGE FORMING METHOD CAPABLE OF DETECTING A RESISTANCE VALUE OF AN INTERMEDIATE TRANSFERRING MEMBER

CROSS-REFERENCE TO RELATED APPLICATION

This application is based upon and claims the benefit of priority from prior Japanese Application No. 2005-192922, filed on Jun. 30, 2005; the entire contents of which are incorporated herein by reference.

BACKGROUND OF THE INVENTION

This invention relates to an image forming apparatus and an image forming method.

In a so-called intermediate transferring type image forming apparatus which transfers toner images on sheets of paper using an intermediate transferring member, a construction to detect a resistance value of the intermediate transferring member and correct a primary transferring voltage output when forming images based on the detected resistance value so as to promote the stability of transferring (so-called primary transfer) efficiency of a toner image formed on an photosensitive surface of a photosensitive drum is so far known.

However, a resistance value of an intermediate transferring member fluctuates depending on environmental conditions such as ambient temperature, humidity, etc. and the influence of disturbing elements such as a printing operation and it is difficult to detect a resistance value of intermediate transferring members at stable sensitivity.

SUMMARY OF THE INVENTION

This invention is made in order for solving problems as mentioned above and it is an object to provide an image forming apparatus capable of detecting a resistance value of an intermediate transferring member at a stable sensitivity irrespective of influence of surrounding environmental disturbing elements and contributing to improvement of image quality at the time of image forming.

To solve the problem aforementioned, the present invention provides an image forming apparatus of an embodiment relating to the present invention, comprising an electric potential controller to fix a surface electric potential on a photosensitive surface of a photosensitive member to a prescribed value; a power source to supply prescribed voltage or current to the photosensitive surface through a transferring surface of an intermediate transferring member; and a resistance detector to detect a current value flowing through the intermediate transferring member against the prescribed voltage supplied from the power source or a voltage value generated in the intermediate transferring member against the prescribed current, and detect a resistance value of the intermediate transferring member based on the detected current value or voltage value.

Further, the present invention provides an image forming method of an embodiment relating to the present invention, comprising controlling a surface electric potential on a photosensitive surface of a photosensitive member to fix at a prescribed value; supplying a prescribed voltage or current to the photosensitive surface through a transferring surface of an intermediate transferring member; and detecting a current value flowing through the intermediate transferring member against the supplied prescribed voltage or a voltage value generated in the intermediate transferring member against the prescribed current, and detecting a resistance value of the intermediate transferring member based on the detected current value or the voltage value.

BRIEF DESCRIPTION OF THE DRAWINGS

FIG. 6 is a table showing coefficients.

FIG. 8 is a table showing examples of computing formulae for computing coefficients.

DETAILED DESCRIPTION OF THE EMBODIMENTS

Hereinafter, an embodiment of this invention will be explained with reference to the attached drawings.

Figure 1:
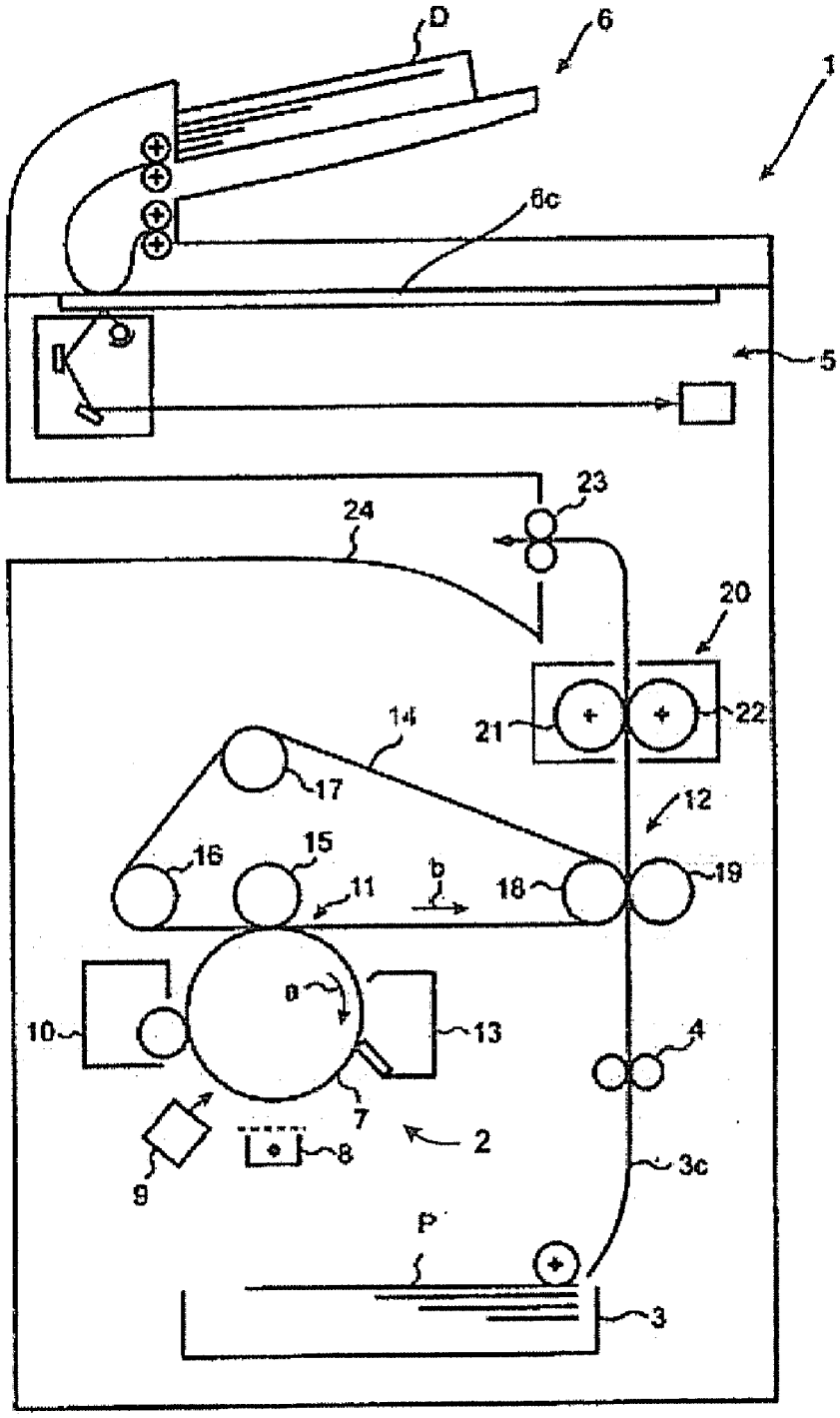
FIG. 1 is a schematic cross-sectional view showing the cross section of an image forming apparatus in one embodiment of this invention.

FIG. 1 is a schematic diagram for explaining the internal construction of an image forming apparatus in this embodiment. An image forming apparatus 1 in this embodiment is composed of, for example, a MFP (Multi Function Peripheral).

In image forming apparatus 1, a paper supply cassette 3 is provided to supply paper P in the direction of an image forming unit 2. Paper P is taken out of paper supply cassette 3, conveyed along a conveying path 3*c* and supplied in the direction of an aligning roller 4. On the upper surface of image forming apparatus 1, a scanner device 5 to read a document image and an automatic document feeder 6 are provided.

Image forming unit 2 is composed of a photosensitive drum 7, a main charger 8, an exposing portion 9, a developing device 10, a primary transferring stage 11, a secondary transferring stage 12 and a cleaner 13 which are arranged along the rotating direction a of photosensitive drum 7.

Primary transferring stage 11 is constructed with an intermediate transferring belt 14 pushed against photosensitive drum 7 with a primary transferring roller 15. Intermediate transferring belt 14 is put over a driving roller 16, a support roller 17 and a secondary transferring roller 18. Intermediate transferring belt 14 is rotated in the arrow direction b by the rotation of driving roller 16. Secondary transferring roller 18 is arranged opposing to an opposing roller 19 by way of intermediate transferring belt 14, and secondary transferring stage 12 is composed of secondary transferring roller 18, intermediate transferring belt 14 and opposing roller 19.

At the downstream side of secondary transferring stage 12, a fixing device 20 is arranged along conveying path 3*c*. Fixing device 20 is composed of a heat roller 21 and a pressure roller 22. Further, at the downstream side of fixing device 20, an exit roller 23 is arranged along conveying path 3*c*. Paper P with an image formed thereon and exits from exit roller 23 is piled up on a receiving tray 24 that is formed above image forming unit 2.

An image on a document D conveyed on a platen glass 6*c* by automatic document feeder 6 is read by scanner device 5. The read image on document D is sent to exposing portion 9 as an image signal. A light image corresponding to the image signal sent from exposing portion 9 is irradiated on photosensitive drum 7 that is uniformly charged by main charger 8 and a latent image is formed on photosensitive drum 7. This latent image is developed by developing device 10 and is converted to a toner image. This toner image is transferred on intermediate transferring belt 14 by the action of primary transferring roller 15.

The toner image transferred on intermediate transferring belt 14 is transferred on paper P that is conveyed on conveying path 3*c* by the action of secondary transferring roller 18 of the secondary transferring stage 12. Paper P with the toner image transferred thereon is heated by the heat roller 21 of fixing device 20 and is fixed on paper P. Paper P with the fixed toner image is fed to receiving tray 24 by exit roller 23.

After the toner image was transferred on intermediate transferring belt 14, toner remaining on photosensitive drum 7 is removed by cleaner 13.

Figure 2:
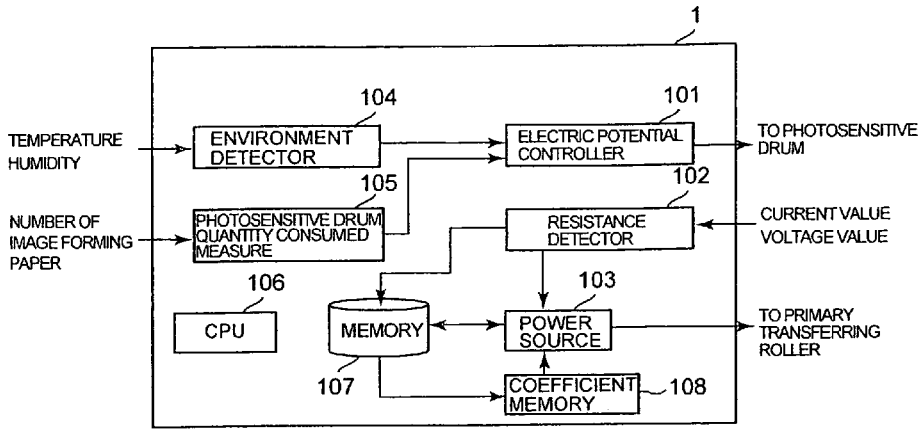
FIG. 2 is a block diagram showing an image forming apparatus of one embodiment of this invention.

Image forming apparatus 1 according to this embodiment further has an electric potential controller 101, a resistance detector 102, a power source 103, an environment detector 104, a photosensitive drum quantity consumed measure 105, a CPU 106, a MEMORY 107 and a coefficient memory 108 as shown in FIG. 2.

Figure 3:
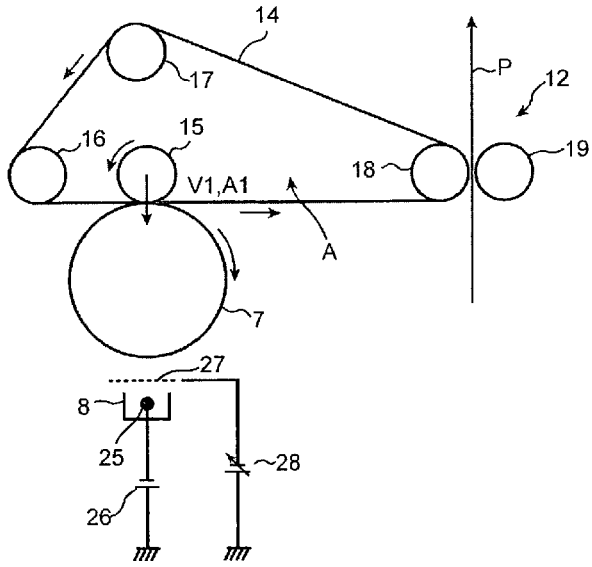
FIG. 3 is a schematic diagram showing the construction around an intermediate transferring member of an image forming apparatus in one embodiment of this invention.
Figure 4:
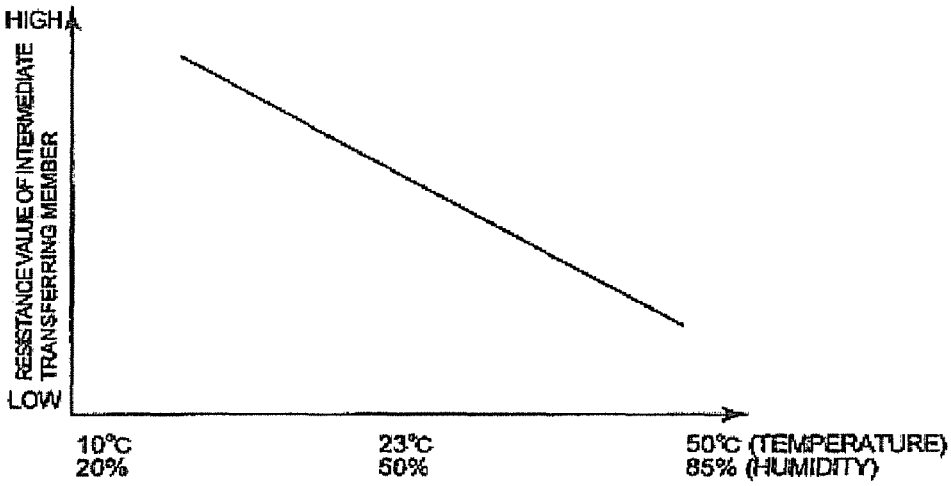
FIG. 4 is a graph showing characteristics of resistance value of an intermediate transferring member such as an intermediate transferring belt.

Electric potential controller 101 controls the electric potential of the photosensitive surface of photosensitive drum 7 so as to fix to a prescribed value. FIG. 3 is a schematic diagram showing the construction around an intermediate transferring member A of the image forming apparatus 1 according to this embodiment. Electric potential controller 101 controls the surface potential of photosensitive drum 7 by controlling a grid bias potential shown in FIG. 3. That is, main charger 8 provided with a grid 27 is arranged in opposition to photosensitive drum 7. There are a power source 26 to supply voltage to a wire 25 of the main charger 8 and a variable power source 28 to supply voltage to the grid 27 provided in the opening of main charger 8. A grid bias potential is controlled by varying a voltage supplied from the variable power source 28.

Power source 103 supplies a prescribed voltage (for example, a fixed value V1) or a prescribed current (for example, a fixed value A1) to the photosensitive surface of photosensitive drum 7 through the transferring surface of intermediate transferring belt 14 from primary transferring roller 15 as shown in FIG. 3. The toner image transferred on intermediate transferring belt 14 is transferred on paper P by secondary transferring roller 18. Further, in this embodiment, the intermediate transferring member A refers to primary transferring roller 15 and intermediate transferring belt 14.

Resistance detector 102 detects a current value flowing through intermediate transferring member A against a prescribed voltage supplied to photosensitive drum 7 from power source 103 or a voltage value or a current value generated against a prescribed current in intermediate transferring member A, and detects the resistance of intermediate transferring member A by computing a resistance value based on the detected current value or voltage value.

That is, in resistance detector 102, a resistance value of intermediate transferring member A is detected by computing a resistance value based on the relation between voltage (V) and current (I).

Further, resistance detector 102 detects a resistance value of intermediate transferring member A in an area wherein no toner image is formed on the photosensitive surface of photosensitive drum 7.

Environment detector 104 detects at least either one of the atmospheric temperature and humidity surrounding intermediate transferring member A as environmental data.

Photosensitive drum quantity consumed measure 105 measures a using volume of photosensitive drum 7 for the image forming in image forming apparatus 1. For example, the number of sheets of paper P on which an image is formed using photosensitive drum 7 is counted. Here, the number of image forming paper to be counted denotes the number of sheets of paper P on which an image is to be formed from now on. Further, for example, the number of sheets of paper on which an image was already formed may be counted. Or the number of revolutions of photosensitive drum 7 may be measured. Furthermore, a driven time of photosensitive drum 7 may be measured. In any case, any method is usable provided that the using volume of photosensitive drum 7 can be measured.

CPU 106 executes various kinds of processes in image forming apparatus 1. That is, various functions are realized by executing programs stored in MEMORY 107. MEMORY 107 is composed of, for example, ROM, RAM, etc. and stores various data and programs that are used in the image forming apparatus 1.

Further, electric potential controller 101 is capable of changing a prescribed value to fix the surface potential of the photosensitive drum 7 based on the environmental data detected by environment detector 104 or the number of papers P counted by photosensitive drum quantity consumed measure 105.

A resistance value of intermediate transferring member A such as intermediate transferring belt 14 varies according to atmospheric temperature and humidity surrounding the intermediate transferring member A. That is, it is known that a resistance value becomes low in a high temperature and humid environment while it becomes high in a low temperature and humid environment.

Figure 5:
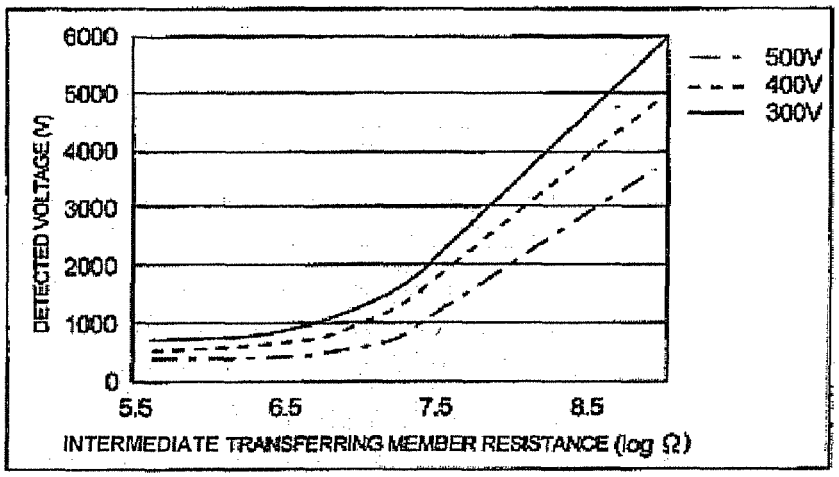
FIG. 5 is a graph showing the relation between the surface potential to fix a photosensitive surface of a photosensitive drum and a resistance value detected when the surface photosensitive surface is fixed at that surface potential.
Figure 7A:
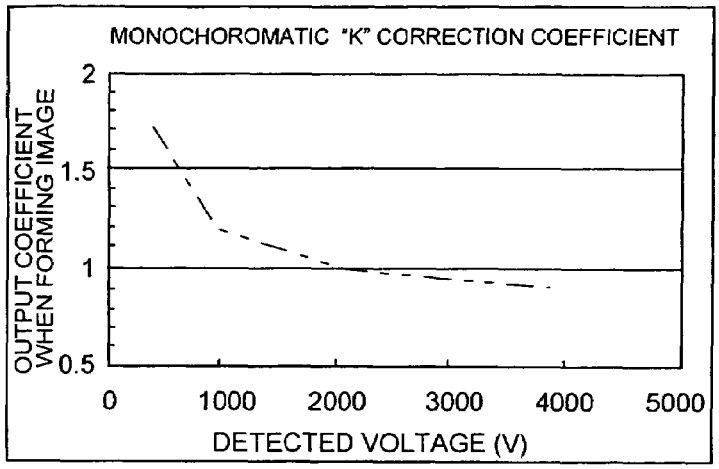
FIGS. 7A to 7E are graphs showing voltage values generated in an intermediate transferring member detected by a resistance detector and tilts each of which is set for every range of prescribed numerical value of a voltage value (a detected voltage)
Figure 7B:
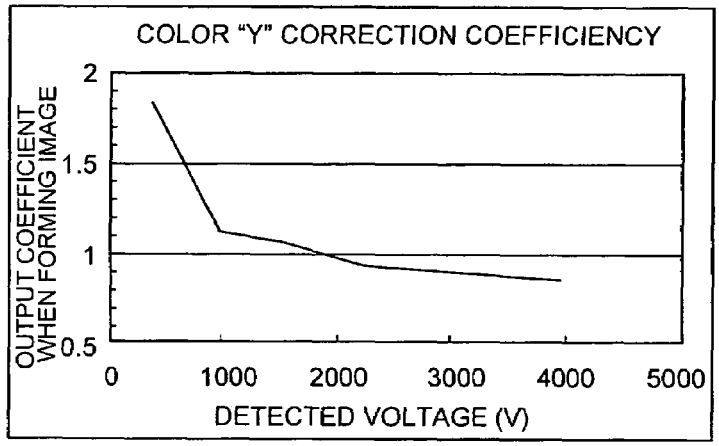
Figure 7C:
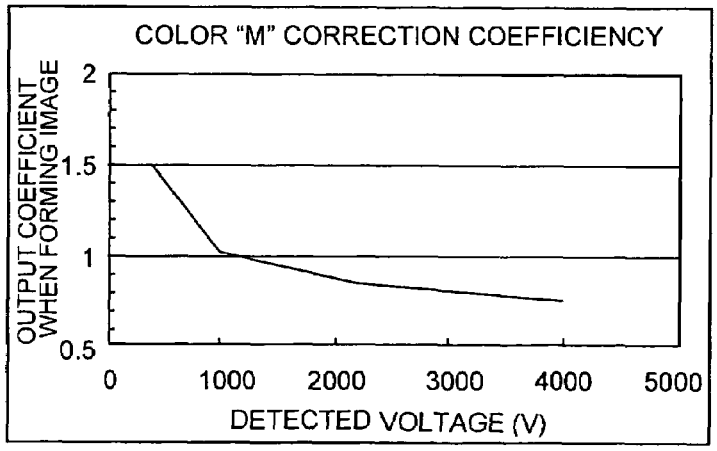
Figure 7D:
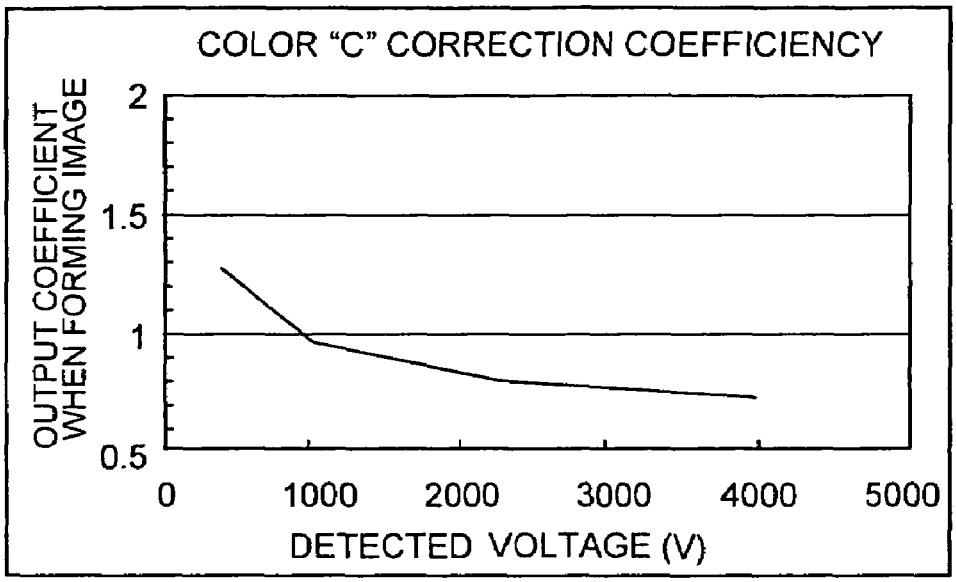
Figure 7E:
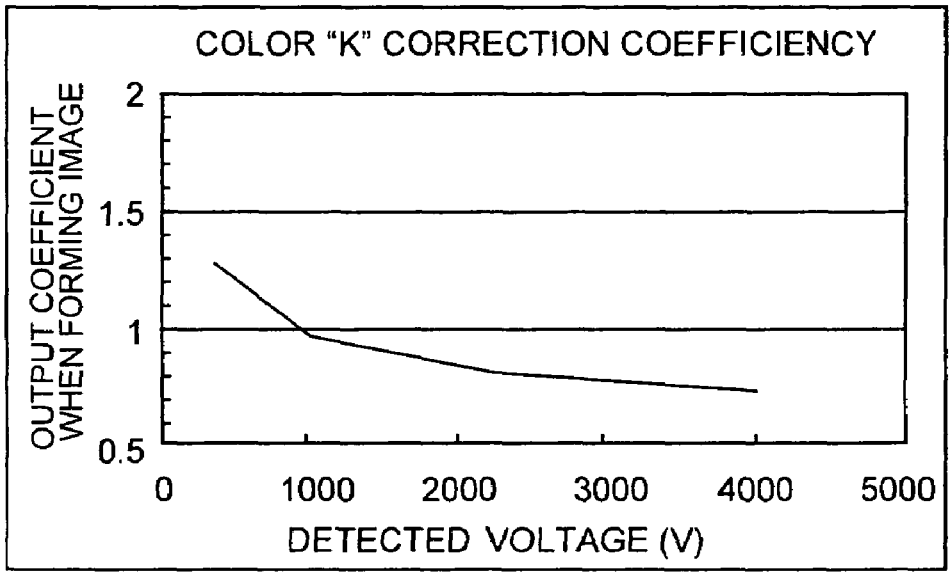

FIG. 5 is a graph showing the relation between a surface electric potential fixing the photosensitive surface of a photosensitive drum and a resistance value detected when the surface electric potential is fixed. As shown in FIG. 5, the detecting sensitivity of resistance values of intermediate transferring members is different depending on set values of surface potentials of photosensitive drums. That is, the detecting sensitivity was most high when the surface potential was fixed at 300V and was most low when the surface potential was fixed at 500V.

The relation of the characteristic of resistance value of intermediate transferring members with the surface potential and the detecting sensitivity is noted. That is, in an environment wherein resistance values become low, the surface potential of a photosensitive drum is set at a value at which the detecting sensitivity becomes high. On the contrary, in an environment wherein resistance values become high, the surface potential is set at a value at which the detecting sensitivity becomes low. Thus, by fixing surface potentials as shown above, the stabilized detection of resistance values of intermediate transferring members is achieved. In other words, by detecting resistance values at a sensitivity according to environments, it becomes possible to make the detection of resistance values at a sensitivity proper to the environment and the detection of resistance values at a proper sensitivity corresponding to the internal state (temperature, etc.) varying according to the number of print sheets in the image forming apparatus.

Further, image forming apparatus 1 in this embodiment is of such structure that power source 103 applies a voltage detected by resistance detector 102 and multiplied with a prescribed coefficient at the time when forming an image on the photosensitive surface of photosensitive drum 7 in the case when a prescribed current is supplied to the photosensitive surface by power source 103 (when a resistance value is detected according to a so-called constant-current system).

Prescribed coefficients are reserved in coefficient memory 108 as shown in FIG. 2. Power source 103 selects a proper prescribed coefficient corresponding to a voltage value received from resistance detector 102 through MEMORY 107 and multiplies the voltage value with a prescribed coefficient. That is, prescribed coefficients are reserved in coefficient memory 108 as "Coefficient Table" as shown in FIG. 6.

In the coefficient table shown in FIG. 6, a coefficient a is set for every color according to voltage (V1) detected in the monochromatic mode and the color mode. For example, the voltage (V1) detected in black (K) of the monochromatic mode is 1000V, the coefficient a will become 1.20. The output voltage V2 in the image transferring at that time will become $$V2=V1\times a=1{,}000\times 1.20=1{,}200(\mathrm{V})$$

When the voltage V1 detected in the magenta (M) of color mode is 600V, the coefficient a will become 1.55. The output voltage V2 in the image transferring at that time will become $$V2=V1\times a=600\times 1.55=930(\mathrm{V})$$

Further, prescribed coefficients here are computed according to a prescribed computing formula that is set for every prescribed numerical range of voltage values detected by resistance detector 102. FIGS. 7A to 7E show graphs of voltage values generated in intermediate transferring members detected by resistance detector 102, having tilts that are set for every range of prescribed numerical values f the voltage values. Further, these graphs show tilts for every color in the monochromatic mode and the color mode.

FIG. 8 shows one example of a formula to compute coefficient A according to detected voltage (V) in the monochromatic mode black (K). For example, when a detected voltage (V) is 1,000V to 1,500V, $A=1.36-1.6\times10^{-4}\times B$, wherein A denotes coefficient and B denotes detected voltage, respectively.

Thus, by setting a voltage in the image forming apparatus 1 according to the detected voltage, it becomes possible to apply a proper voltage value with less error corresponding to detected voltage and make the transferring efficiency to an intermediate transferring member A of a toner image formed on the photosensitive surface of a photosensitive drum 7 suitable.

Figure 9:
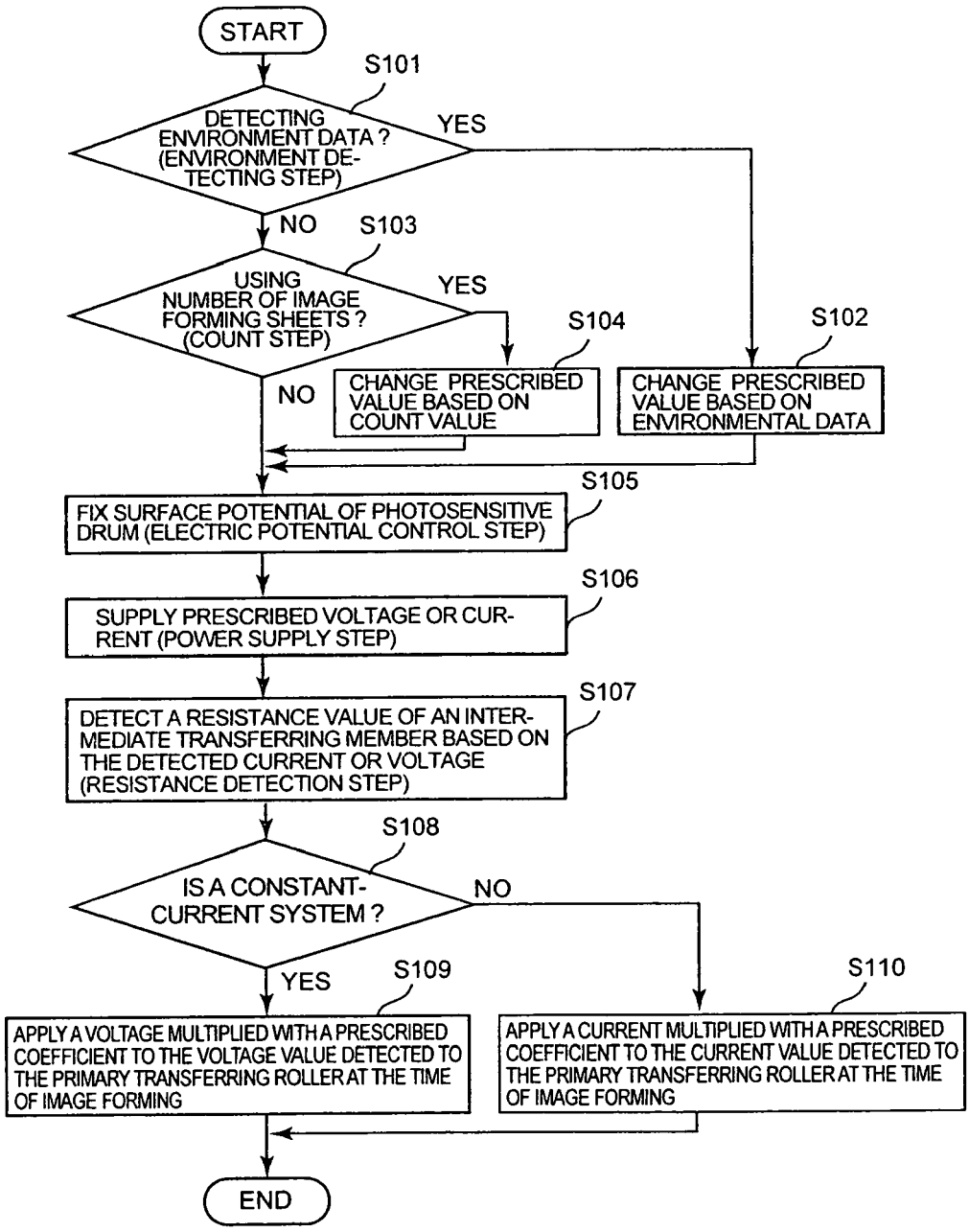
FIG. 9 is a flowchart for explaining the process flow (the image forming method) in an image forming apparatus which is one embodiment of this invention.

FIG. 9 is a flowchart for explaining the process flow (the image forming method) in the image forming apparatus 1 according to this embodiment.

First, when setting the surface potential of the photosensitive drum 7 corresponding to temperature and humidity, at least either one of temperature and humidity is detected as an environmental data by environment detector 104 (Environmental Detection Step S101).

Electric potential controller 101 changes a prescribed value to fix the surface potential of the photosensitive drum 7 based on the environmental data detected in environmental detecting step S101 (Electrical Potential Control Step S102).

On the other hand, to set the surface potential of the photosensitive drum 7 corresponding to accumulated number of sheets on which an image is to be formed instead of environmental data, accumulated number of sheets with an image formed is counted by photosensitive drum quantity consumed measure 105 (Count Step S103).

Electrical potential controller 101 changes a prescribed value to fix the surface potential of the photosensitive surface based on the number of sheets counted in the count step S103 (Electrical Potential Control Step S104).

Then, electric potential controller 101 fixes the surface potential of the photosensitive surface of the photosensitive drum 7 at a prescribed value as described above (Electrical Potential Control Step S105).

In succession, power source 103 supplies a prescribed voltage or current to the photosensitive surface of the photosensitive drum 7 through the transferring surface of the intermediate transferring member A (Power Supply Step S106).

Resistance detector 102 detects a current value flowing through the intermediate transferring member A against the prescribed voltage supplied in the power supply step S106 or a voltage value generated in the intermediate transferring member A against a prescribed current value and detects a resistance value of the intermediate transferring member A based on the detected current value or the voltage value (Resistance Detecting Step S107).

Then, in the case wherein a prescribed current is supplied to the photosensitive surface in the power supply step S106 (the constant current system) (S108, YES), power source 103 applies a voltage multiplied with a prescribed coefficient selected from coefficient memory 108 to the voltage value detected in resistance detecting step S107 to the primary transferring roller 15 at the time of image forming on the photosensitive surface (Step S109).

In the case of other than the (constant-current system) wherein prescribed current is supplied to the photosensitive surface (S108, NO) in the power supply step S106, a value of detected current multiplied with a prescribed coefficient is applied to primary transferring roller 15 at the time of the image forming (Step S110).

Further, in this embodiment, prescribed coefficients are set not only for every prescribed range of numerical numbers of detected voltage but also for every toner color (cyan, magenta, yellow) individually. As a charged amount of toner differs for colors, when voltage applied to the photosensitive drum is varied at the time of image forming, it becomes possible to form an image at a more suitable voltage value and contribute to the improvement of the image quality at the time of the image forming.

Each of the process steps in the image forming apparatus 1 described above is realized when an image forming program stored in MEMORY 107 is executed by CPU 106.

This embodiment is explained above when the functions to execute the invention are pre-recorded in the apparatus; however, not restricted to this, similar functions may be downloaded in the apparatus through a network or recorded in a recording medium and installed in the apparatus. Recording media in any shapes, for example, CD-ROM capable of storing programs and readable by an apparatus are usable. Further, the functions that are obtained by installing or loading in advance may be those that can be realized in corporation with OS (Operating Systems), etc.

As described above, according to this embodiment, it is possible to detect a resistance value of a transferring member (an inherent resistance or an environmental change) with a high follow-up efficiency.

Further, in this embodiment, the structure to change a voltage value to fix the surface potential of a photosensitive drum based on temperature, humidity and counted value is shown but the structure is not restricted to this and can be in a structure, for example, to reset the surface potential for the second detection of a resistance value of intermediate transferring member based on the measured resistance obtained by the first detection of a resistance of the intermediate transferring member.

Further, in this embodiment, a surface potential value of the photosensitive drum is determined based on the result in either environment detection step S101 or count step S103 but the surface potential value of the photosensitive drum may be decided based on the results in both steps.

This invention is explained above in detail in a specific aspect but it is obvious that various changes and modifications may be made in the invention without departing from the spirit and scope thereof.

According to this invention as described above in detail, it is possible to provide a technology capable of detecting resistance values of intermediate transferring members at a stabilized sensitivity and contributing to the improvement of image quality in the image development irrespective of influence of environment and disturbance.

What is claimed is:

1. An image forming apparatus comprising:

an electric potential controller to fix a surface electric potential on a photosensitive surface of a photosensitive member to a prescribed value;

a power source to supply prescribed voltage or current to the photosensitive surface through a transferring surface of an intermediate transferring member; and a resistance detector to detect a current value flowing through the intermediate transferring member against the prescribed voltage supplied from the power source or a voltage value generated in the intermediate transferring member against the prescribed current, and detect a resistance value of the intermediate transferring member based on the detected current value or voltage value.

2. The image forming apparatus according to claim 1, further comprising:

an environment detector to detect at least one of temperature and humidity as environmental data, wherein the electric potential controller changes a prescribed value to fix the surface electric potential on the photosensitive surface based on the environmental data detected by the environment detector.

3. The image forming apparatus according to claim 1, further comprising:

a photosensitive member quantity consumed measure to measure a photosensitive member quantity consumed, wherein the electric potential controller changes a prescribed value to fix the surface electric potential of the photosensitive surface based on a photosensitive member quantity consumed measured by the photosensitive member quantity consumed measure.

4. The image forming apparatus according to claim 3, wherein the photosensitive member quantity consumed measure executes at least one of a counting of the number of sheets on which an image is formed, a measuring of the number of revolutions of the photosensitive member, and a measuring of a driving time of the photosensitive member.

5. The image forming apparatus according to claim 1, wherein, when prescribed current is supplied to the photosensitive surface from the power source, the power source applies voltage detected by the resistance detector and multiplied with a prescribed coefficient to the photosensitive surface, the prescribed coefficient is computed according to a prescribed computing formula that is set for every range of numerical value of voltage detected by the resistance detector.

6. The image forming apparatus according to claim 5, wherein the prescribed coefficient is set for every toner color used in the image forming on the photosensitive surface.

7. An image forming method comprising:

controlling a surface electric potential on a photosensitive surface of a photosensitive member to fix at a prescribed value;

supplying prescribed voltage or current to the photosensitive surface through a transferring surface of an intermediate transferring member; and detecting a current value flowing through the intermediate transferring member against the supplied prescribed voltage or a voltage value generated in the intermediate transferring member against the prescribed current, and detecting a resistance value of the intermediate transferring member based on the detected current value or the voltage value.

8. The image forming method according to claim 7, further comprising:

detecting at least one of temperature and humidity as environmental data, wherein the controlling changes a prescribed value to fix the surface electric potential on the photosensitive surface based on the environmental data detected in the detecting.

9. The image forming method according to claim 7, further comprising:

measuring the photosensitive member quantity consumed that is used in the image forming, wherein the controlling changes a prescribed value to fix the surface electric potential of the photosensitive surface based on the photosensitive member quantity consumed measured.

10. The image forming method according to claim 7, wherein, when a prescribed current is supplied to the photosensitive surface in the supplying, a voltage value detected in the detecting and multiplied with a prescribed coefficient is supplied in the image forming on the photosensitive surface and the prescribed coefficient is computed based on a prescribed computing formula that is set for every prescribed range of numerical value of voltage detected in the resistance detecting.

11. The image forming method according to claim 10, wherein the prescribed coefficient is set for every toner image that is used in the image forming on the photosensitive surface.

12. An image forming apparatus comprising:

electric potential control means for fixing a surface electric potential on a photosensitive surface of a photosensitive member at a prescribed value;

power source supply means for supplying prescribed voltage or current to the photosensitive surface through a transferring surface of an intermediate transferring member; and resistance detecting means for detecting a current value flowing through the intermediate transferring member against the prescribed voltage supplied from the power source supply means or a voltage value generated in the intermediate transferring member against the prescribed current, and detecting a resistance value of the intermediate transferring member based on the detected current value or voltage value.

13. The image forming apparatus according to claim 12, further comprising:

environment detecting means for detecting at least one of temperature and humidity as environmental data, wherein the electric potential control means changes a prescribed value to fix the surface electric potential on the photosensitive surface based on the environmental data detected by the environment detecting means.

14. The image forming apparatus according to claim 12, further comprising:

measuring means for measuring a consumed quantity of the photosensitive member, wherein the electric potential control means changes a prescribed value to fix the surface electric potential of the photosensitive surface based on the photosensitive member quantity consumed measured by the measuring means.

15. The image forming apparatus according to claim 14, wherein the measuring means executes at least one of a counting of the number of record paper sheets with an image formed, a measuring of the number of revolutions of the photosensitive member; and a measuring of a driving time of the photosensitive member.

16. The image forming apparatus according to claim 12, wherein, when supplying prescribed current to the photosensitive surface, the power source supply means supplies a voltage value multiplied with a prescribed coefficient to the voltage value detected by the resistance detecting means in the image forming on the photosensitive surface, and the prescribed coefficient is computed based on a prescribed computing formula that is set for every range of specified numerical value of voltage detected by the resistance detecting means.

17. The image forming apparatus according to claim 16, wherein the prescribed coefficient is set for every color toner that is used in the image forming on the photosensitive surface.

* * * * *